US008096245B2

(12) United States Patent
Silverman

(10) Patent No.: US 8,096,245 B2
(45) Date of Patent: Jan. 17, 2012

(54) SURFACE COVERINGS

(75) Inventor: Robert Silverman, Long Beach, CA (US)

(73) Assignee: Kittrich Corporation, La Mirada, CA (US)

( * ) Notice: Subject to any disclaimer, the term of this patent is extended or adjusted under 35 U.S.C. 154(b) by 0 days.

(21) Appl. No.: 12/769,174

(22) Filed: Apr. 28, 2010

(65) Prior Publication Data

US 2011/0048290 A1 Mar. 3, 2011

Related U.S. Application Data

(63) Continuation of application No. 11/674,361, filed on Feb. 13, 2007, now abandoned.

(51) Int. Cl.
*A47B 13/08* (2006.01)

(52) U.S. Cl. ..... 108/90

(58) Field of Classification Search ..... 108/90; 150/158, 156, 154
See application file for complete search history.

(56) References Cited

U.S. PATENT DOCUMENTS 3,939,976 A 2/1976 Vanlseghem, Jr. et al.
4,705,084 A 11/1987 Rodebaugh et al.
4,716,840 A 1/1988 Tringali et al.
5,069,554 A 12/1991 Bonnett
5,538,147 A 7/1996 Fucci
5,697,302 A 12/1997 Putnam
5,863,845 A 1/1999 Owen
5,874,371 A 2/1999 Owen
5,887,530 A 3/1999 Muller
6,001,460 A 12/1999 Morman et al.
6,022,617 A 2/2000 Calkins
6,086,995 A 7/2000 Smith
6,096,668 A 8/2000 Abuto et al.
6,116,167 A 9/2000 Rabe
6,159,583 A 12/2000 Calkins
6,207,237 B1 3/2001 Haffner
6,238,762 B1 5/2001 Friedland
6,457,423 B1 10/2002 Gordon
6,959,652 B2 11/2005 Kuhl et al.
7,320,287 B2 1/2008 Edinger et al.
7,461,602 B2 12/2008 Stanford
7,469,962 B2 * 12/2008 Paulin ..... 297/229
2003/0077423 A1 * 4/2003 Flanigan et al. ..... 428/166
2003/0124928 A1 * 7/2003 Sherrod et al. ..... 442/76
2008/0038982 A1 * 2/2008 Motomura et al. ..... 442/382
2008/0138551 A1 * 6/2008 Gordon ..... 428/35.7

OTHER PUBLICATIONS

Plastic Shelf Liner Advertisement, Published Feb. 2006, Conimar Corporation.

* cited by examiner

*Primary Examiner* — Jose V Chen
(74) *Attorney, Agent, or Firm* — SNR Denton US LLP; Brian R. McGinley

(57) ABSTRACT

The present invention is directed to a non-adhesive covering for a shelf. In one embodiment, it includes a substantially incompressible polymer-based material with an upper surface comprising an embossed pattern, lays flat upon a shelf surface, has a thickness of 4 gauge or above, and has a PHR in a range of 28 to 42. In another embodiment, it includes a substantially incompressible polymer-based material, lays flat upon a shelf surface, has a thickness of 2.8 gauge or above, and has a PHR in a range of 28 to 42.

11 Claims, 2 Drawing Sheets

SURFACE COVERINGS

CROSS-REFERENCE

This application is a continuation of U.S. patent application Ser. No. 11/674,361, filed on Feb. 13, 2007 now abandoned.

FIELD OF THE INVENTION

The present invention relates generally to cover liners, and more specifically to a novel cover liner that has a plurality of characteristics and is adapted to be used with any surface, such as shelves, table tops, benches, and seating.

BACKGROUND OF THE INVENTION

Shelf covers are in wide use as they provide a protective layer for shelves. Most commonly used are shelf covers with an adhesive backing. The adhesive backing is, however, often difficult to use because it is challenging to layer onto a surface without creating unwanted bumps or creases or by making it difficult to remove in the future without causing damage to the underlying surface.

Informal solutions such as cutting a rectangular shaped piece of cardboard to rest on top of the shelves are known in the prior art. However, this type of cover is prone to unwanted sliding, offers an aesthetically unattractive appearance, and is generally hard to clean.

A shelf covering is described in U.S. Pat. No. 5,697,302 by Putnam. The '302 patent describes "a relatively thick shelf covering for use with wire-frame shelves. The material is sufficiently thick to prevent objects from falling through or tilting into the spaces between the gratings of a wire-frame shelf. The material is also flexible enough to be sold in rolls. The material is also impervious to water and most common household chemicals."

This and other prior art shelf coverings solve some of the problems inherent in shelf coverings, but they introduce other complexities that reduce the re-usability of these covers and at the same time result in less than straightforward manufacturing. For example, the shelf covering of the '302 patent requires "a notch spanning the length of the covering that follows the frontal grating when in use." Since the notch is present only towards one edge of the covering, the covering cannot be used in any other way but to have the notched edge of the covering facing outwardly from the shelves. Also, once the shelf covering has been bent downwards at the notch it cannot be brought back to its original planar form for deployment over shelves that may not have frontal gratings (that need covering).

Additionally, when compressible and flexible materials are used for the shelf coverings these materials tend to deform overtime under the weight of the items being placed upon them.

Accordingly a need exists for a shelf cover that does not have the limitations of the prior art, is sufficiently sturdy and incompressible, relatively straightforward to manufacture, use and is also cost effective. There is also a need in the prior art for shelf covers that possess characteristics such as soft 'hand feel' or 'PHR', aesthetic appearance and breathability.

SUMMARY OF THE INVENTION

According to an object of the invention the shelf cover liner is a substantially planar sheet of plastic shelf liner that is of a suitable thickness and "lays flat" when placed onto a surface.

The liner is made of a substantially incompressible plastic material. The aforementioned characteristics of the cover liner are provided via suitable treatment of materials such as poly-vinyl chloride (PVC), polyutherane (PUR), oriented polypropylene (OPP), ethylene-vinylacetate (EVA), or any other polymer-based material resin known to persons of ordinary skill in the art.

According to another object of the invention the shelf cover liner possesses a soft 'hand feel' as characterized by concentration of suitable elastomer such as latex, rubber, or resins granules PHR (parts per hundred parts resin) values ranging from 28 to 42.

According to another object of the invention the shelf cover liner possesses a soft 'hand feel' as characterized by concentration of suitable elastomer such as latex, rubber, resins or leather/fabric granules PHR (parts per hundred parts resin) values ranging from 28 to 42.

According to another object of the invention the top and/or the bottom surfaces of the shelf covering may or may not be embossed with a plurality of patterns such as lines, checkers, swirls and diamonds. In some embodiments these embossed patterns are in the form of ridges, corrugations or contours. These ridges or corrugations require one raised portion (ridge) to be separated from the other raised portion by a valley.

In alternate embodiments the space between two adjacent ridges varies across the two edges of the shelf cover. Also the shape and size of the ridges varies from a convex dome shaped structure to circular, trapezoidal, pyramidal, tetrahedron, rectangular, square or any other shape that may be evident to persons of ordinary skill in the art.

According to still another object of the present invention the shelf cover liner possesses breathability to allow for ambient air to percolate through items placed on the shelf cover.

BRIEF DESCRIPTION OF THE DRAWINGS

These and other features and advantages of the present invention will be further appreciated, as they become better understood by reference to the following Detailed Description when considered in connection with the accompanying drawings.

DETAILED DESCRIPTION OF THE DRAWINGS

Shelf coverings are in extensive use to cover shelves in shops, closets or kitchen pantries. While the shelf covering of the present invention has been described with reference to typical solid shelves, it is an intention of the inventors to use the novel shelf coverings with wire-frame shelves, table top coverings or as an aesthetic, protective and robust covering for any furniture item, electronic item such as televisions, DVD players, etc. Thus, the use of the novel shelf covering of the present invention is wide and is not restricted to use with any particular shelf surface.

Figure 1:
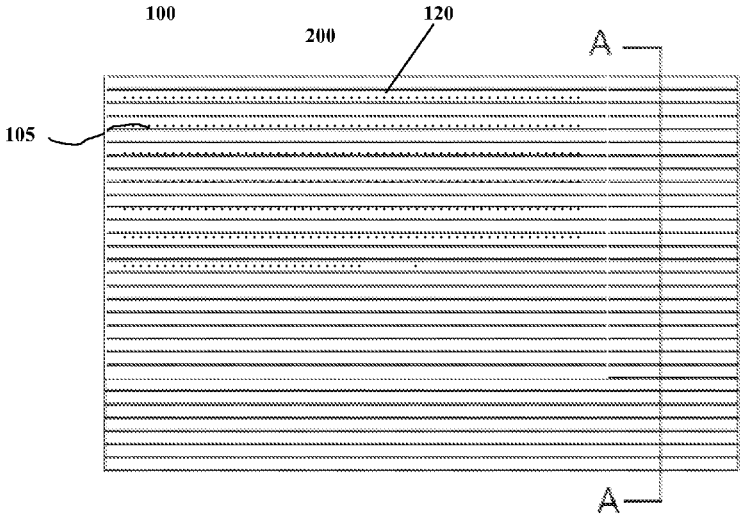
FIG. 1 shows top view of a shelf cover liner of the present invention.
Figure 2:
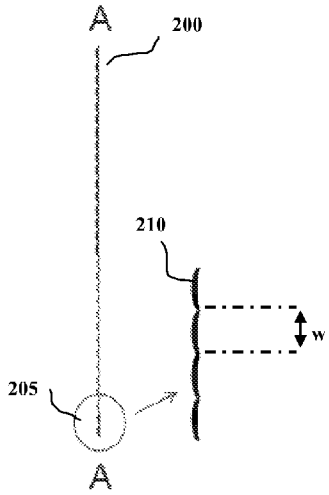
FIG. 2 shows a cross-sectional view of the shelf cover liner along section A-A.

FIG. 1 shows top view 105 of a shelf cover liner 100 of the present invention and FIG. 2 shows a cross-sectional view of the shelf cover liner 200 along section A-A. The shelf cover liner is a generally planar, sheet of relatively rigid and substantially incompressible material adapted to rest upon shelves and possess a 'lay flat' characteristic.

The shelf cover liner 200 of the present invention possesses a first characteristic of being non adhesive and therefore easy to handle as users are not faced with the complications of properly laying down the liner. Persons of ordinary skill would recognize the fact that users face a lot of difficulty in properly adjusting and aligning such covers on shelves, because, conventionally, they stick to the shelves as soon as they are placed on the shelves and, as such, users are required to peel them off repeatedly until these are placed on the shelves as desired. Furthermore, users are not faced with the problem of damaging the underlying surface when attempting to remove a liner that has been adhered, with an adhesive, to the underlying surface.

A second desirable characteristic of the cover liner of the present invention is its ability to 'lay flat' by being sufficiently rigid and substantially incompressible with suitable thicknesses and yet having a 'soft touch' feel (hand feel or "PHR") to the hand and aesthetically pleasing to the eye.

The cover liner further possesses breathability properties i.e., it allows air to flow through such that articles placed on the cover remain dry.

The aforementioned characteristics of the cover liner are provided via suitable treatment of materials such as polyvinyl chloride (PVC), polyutherane (PUR), oriented polypropylene (OPP), ethylene-vinylacetate (EVA) or any other polymer-based material known to persons of ordinary skill in the art. For example, in one embodiment the cover liner is formed of a foamed polyvinyl chloride layer that has soft hand feel for the top surface and an abraded lower surface. The cover liner may contain microperforations, shown as 120 in FIG. 1, that helps provide breathability to the liner. Polymer-based materials such as PVC can be doped with suitable elastomers such as latex, rubber, or resins to develop a soft hand feel to the material. As known to persons of ordinary skill in the art PHR (parts per hundred parts resin) is a measurement of the 'soft touch' feel and can be suitably modified by adding additives so as to attain a desirable hand feel and yet retain enough rigidity and incompressibility to allow a 'lay flat' characteristic.

It is also an intention of the inventors to allow for the liner cover to be aesthetically pleasing. For this, the liner is embossed with patterns such as lines, checkers, swirls, diamonds etc. In alternate embodiments the liner material is doped with at least one pigment or colorant (such as red iron oxide) and optionally at least one odor making agent such as an extract of vanilla or any other such colorant and/or odorant known to persons.

The following description discloses embodiments for the upper surface of the liner comprising different types of embossed patterns for varied look and affected rigidity of the liner.

Referring back to FIG. 2 an enlarged view of a portion 205 of the cross-section A-A of the shelf cover liner 200 is shown. The liner 200 comprises a plurality of parallel lengthwise embossed ridges or corrugations 210 that have suitable width 'w' such that when the liner 200 is used with the ridges pointing upwards, they provide sufficient friction to shelved goods so that the goods do not easily get displaced when placed on the ridges. One ridge is separated from the other ridge by a valley. In one embodiment width 'w' is approximately 3.5 millimeters.

Figure 3:
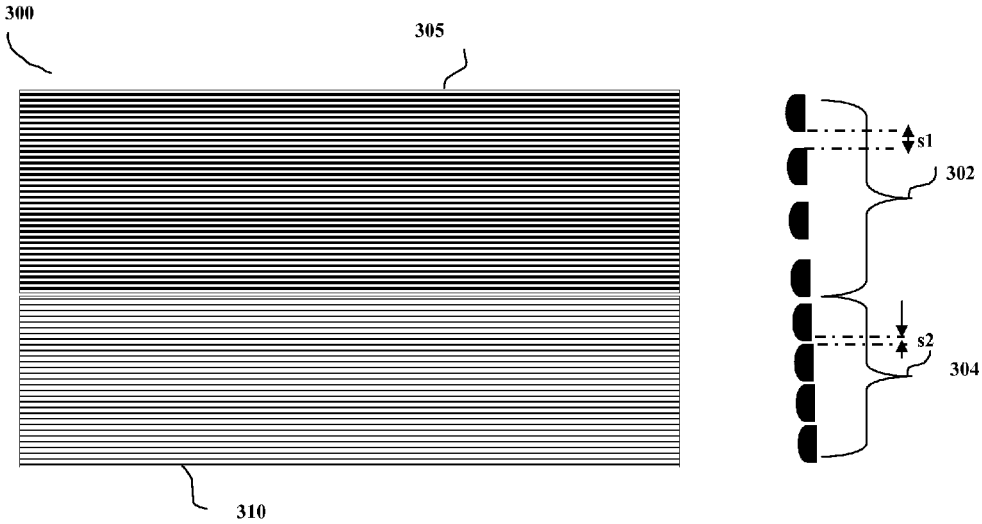
FIG. 3 shows a first embodiment of the corrugations or ridges on the top surface of the shelf cover liner.
Figure 4:
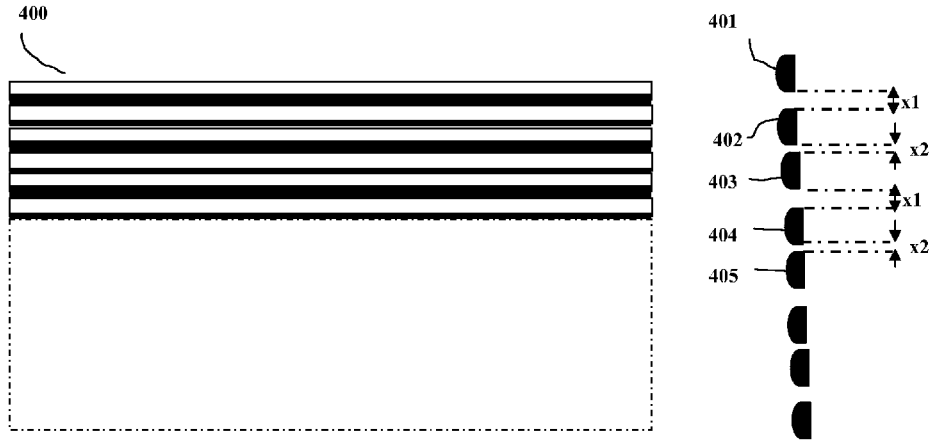
FIG. 4 shows a second embodiment of the corrugations or ridges on the top surface of the shelf cover liner.

While in one embodiment the ridges or corrugations 210 are evenly spaced apart in alternate embodiments they have variable spacing. FIG. 3 shows one example of the top view of the shelf cover liner 300 where a first set of ridges 302 near one edge 305 of the liner 300 have spacing 's1' between them whereas a second set of ridges 304 near the second edge 310 have spacing 's2' such that s1 is not equal to s2. Also, the first and the second set of ridges are equal in number in one embodiment while they are different in number in other embodiments. FIG. 4 shows another example of the top view of the shelf cover liner 400 where one line of ridges 401 is separated by spacing 'x1' from the second line of ridges 402 and the second line of ridges 402 is separated by spacing 'x2' from the third line of ridges 403. The third line of ridges 403 is again separated by spacing 'x1' from the fourth line 404 and the fourth line of ridges 404 is separated by spacing 'x2' from the fifth line 405 and so on. Other such combinations or patterns of ridges with varying spacing would be evident to persons of ordinary skill in the art and are hereby embodied within the scope of the present invention.

Referring back to FIG. 2, in one embodiment the embossed ridges or corrugations 210 are dome shaped such that they are slightly convex on the top of the liner and slightly concave on the bottom of the liner. In alternate embodiments the ridges 210 are circular, rectangular, square, trapezoidal, pyramidal, tetrahedron, or of any other suitable shape as would be evident to persons of ordinary skill in the art.

While the aforementioned embodiments have been described with ridges or corrugations only at the top surface of the shelf cover liner, other embodiments may have corrugations on both the top as well as the bottom surface of the liner. Further the corrugations on one side of the liner may have different patterns in terms of spacing between the ridges/corrugations as well as the shapes of the corrugations while these spacing and corrugation shapes are substantially different on the other side of the shelf cover liner.

For example, in one embodiment the top surface of the shelf cover liner has rectangular shaped evenly spaced corrugations for supporting and providing enough friction to the shelved items while the bottom surface comprises convex shaped corrugations that are sufficiently widely spaced from each other such that they provide friction thereby preventing the movement of the shelf cover liner relative to the shelf.

It would be evident to persons of ordinary skill in the art that various embodiments of the cover liner are possible with the inclusion or exclusion of different characteristics of the liner as disclosed in the foregoing description.

Thus, in one embodiment, the liner has a thickness of 4 gauge or above, has embossed patterns as described above, possesses a soft hand feel PHR range from 28 to 42, and more specifically 32 to 38, and is made of a polymer-based material that provides sufficient rigidity to allow for the 'lay flat' characteristic.

In an alternate embodiment, the liner has a thickness of 2 gauge or greater, does not have patterns embossed on any surface, possesses a soft hand feel PHR range from 28 to 42, and more specifically 32 to 38 and is made of a polymer-based material that provides sufficient rigidity to allow for the 'lay flat' characteristic.

In another embodiment, the non-adhesive covering comprises a substantially incompressible polymer-based material having a length and width, wherein the polymer-based material has an upper surface comprising an embossed pattern, wherein the non-adhesive covering for the shelf lays flat upon the shelf surface and wherein the covering has a PHR in a range of 28 to 42, and more specifically in the range of 32 to 38. The thickness is 4 gauge or above. The embossing pattern is selected from the group comprising of lines, checkers, swirls and diamonds. The polymer-based material is extrudable and selected from the group comprising of vinyls, polyutherane (PUR), oriented polypropylene (OPP), ethylene-vinylacetate (EVA) and rubbers.

In another embodiment, the non-adhesive covering comprises a substantially incompressible polymer-based material having a length and width, wherein the polymer-based material has a smooth upper surface, wherein the non-adhesive covering for the shelf lays flat upon the shelf surface and wherein the covering has a PHR in a range of 28 to 42, and more specifically in the range of 32 to 38. The thickness is 2.8 gauge or above. The polymer-based material is extrudable and selected from the group comprising of vinyls, polyutherane (PUR), oriented polypropylene (OPP), ethylene-vinylacetate (EVA) and rubbers.

In another embodiment, the non-adhesive covering comprises a substantially incompressible polymer-based material having a length and width, wherein the polymer-based material has an embossed, wherein the non-adhesive covering for the shelf lays flat upon the shelf surface and wherein the covering has a PHR in a range of 28 to 42, and more specifically in the range of 32 to 38. The thickness is slightly greater than the depth of the embossed pattern. The polymer-based material is extrudable and selected from the group comprising of vinyls, polyutherane (PUR), oriented polypropylene (OPP), ethylene-vinylacetate (EVA) and rubbers.

Although the present invention has been particularly shown and described above with reference to the above described embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. A non-adhesive covering for a shelf having a surface, comprising a substantially incompressible polymer-based material having a length and width and a plurality of microperforations therein, wherein said polymer-based material has an upper surface comprising an embossed pattern, said embossed pattern comprising a plurality of ridges separated by a first width of around 3.5 millimeters, wherein the non-adhesive covering for the shelf lays flat upon the shelf surface, wherein the non-adhesive covering has a thickness of at least 2 gauge and wherein the polymer-based material is doped with a suitable elastomer such that the non-adhesive covering has a parts per hundred resin (PHR) of said elastomer in a range of 28 to 42.

2. The non-adhesive covering according to claim 1, wherein the covering has a PHR in the range of 32 to 38.

3. The non-adhesive covering according to claim 1, wherein the thickness of the covering is 4 gauge or above.

4. The non-adhesive covering according to claim 1, wherein the embossing pattern in selected from the group comprising of lines, checkers, swirls and diamonds.

5. The non-adhesive covering according to claim 1, wherein the polymer-based material is extrudable and selected from the group comprising of vinyls, polyutherane, OPP, ethylene-vinylacetate and rubbers.

6. A non-adhesive covering for a shelf having a surface, comprising: a substantially incompressible polymer-based material of indeterminate length and a plurality of microperforations therein, wherein the covering for the shelf lays flat upon the shelf surface, wherein the polymer-based material is doped with a suitable elastomer such that the non-adhesive covering has a parts per hundred resin (PHR) of said elastomer in a range of 28 to 42, wherein the thickness is 2.8 gauge or greater, and wherein said polymer-based material has an upper surface comprising an embossed pattern, said embossed pattern comprising a plurality of ridges separated by a first width of around 3.5 millimeters.

7. The non-adhesive covering according to claim 6, wherein the covering has a PHR in the range of 32 to 38.

8. The non-adhesive covering according to claim 6, wherein the thickness of the covering is between 4 and 8 gauge.

9. The non-adhesive covering according to claim 6, wherein the polymer-based material is extrudable and selected from the group comprising of vinyls, polyutherane, OPP, ethylene-vinylacetate and rubbers.

10. A non-adhesive covering for a shelf having a surface, comprising: a substantially incompressible polymer-based material of indeterminate length and a plurality of microperforations therein, wherein the covering for the shelf lays flat upon the shelf surface, wherein the polymer-based material is doped with a suitable material selected from the class consisting of leather, rubber, latex, or fabric such that the non-adhesive covering has a parts per hundred resin (PHR) of said suitable material in a range of 28 to 42, wherein the thickness is 2.8 gauge or greater, and wherein said polymer-based material has an upper surface comprising an embossed pattern, said embossed pattern comprising a plurality of ridges separated by a first width of around 3.5 millimeters.

11. The non-adhesive covering of claim 10 wherein said embossed pattern further comprises a plurality of ridges separated by a second width that is different than said first width.

* * * * *